US006942015B1

(12) United States Patent
Jenkins

(10) Patent No.: US 6,942,015 B1
(45) Date of Patent: Sep. 13, 2005

(54) BODY HEATING/COOLING APPARATUS

(75) Inventor: Donny Ray Jenkins, Edgefield, SC (US)

(73) Assignee: Jenkins Comfort Systems, LLC, Augusta, GA (US)

( * ) Notice: Subject to any disclaimer, the term of this patent is extended or adjusted under 35 U.S.C. 154(b) by 496 days.

(21) Appl. No.: 09/679,698

(22) Filed: Oct. 5, 2000

(51) Int. Cl.[7] ..... F28F 7/00; A41D 1/04

(52) U.S. Cl. ..... 165/46; 165/104.14; 62/259.3; 2/102; 2/458

(58) Field of Search ..... 165/10, 46, 80.4, 165/104.21, 104.14; 62/259.3; 2/102, 457, 2/458

(56) References Cited

U.S. PATENT DOCUMENTS

| | | | | | |
|---|---|---|---|---|---|
| 2,932,491 | A | * | 4/1960 | Miller | 165/170 |
| 3,406,678 | A | | 10/1968 | Hanks | |
| 3,610,323 | A | * | 10/1971 | Troyer | 165/46 |
| 4,691,762 | A | | 9/1987 | Elkins et al. | |
| 4,738,119 | A | * | 4/1988 | Zafred | 62/259.3 |
| 4,932,403 | A | * | 6/1990 | Scholley | 128/205.22 |
| 4,964,405 | A | * | 10/1990 | Arnoth | 128/205.17 |
| 4,998,415 | A | * | 3/1991 | Larsen | 62/259.3 |
| 5,036,845 | A | * | 8/1991 | Scholley | 128/205.22 |
| 5,174,285 | A | * | 12/1992 | Fontenot | 165/46 |
| 5,201,365 | A | | 4/1993 | Siegel | |
| 5,269,369 | A | * | 12/1993 | Faghri | 165/46 |
| 5,320,164 | A | | 6/1994 | Szczesuil | |
| 5,381,510 | A | * | 1/1995 | Ford et al. | 165/46 |
| 5,411,494 | A | * | 5/1995 | Rodriguez | 165/46 |
| 5,433,083 | A | | 7/1995 | Kuramarohit | |
| 5,438,707 | A | * | 8/1995 | Horn | 2/457 |
| 5,456,701 | A | * | 10/1995 | Stout | 165/46 |
| 5,460,012 | A | * | 10/1995 | Kwok | 165/46 |
| 5,538,583 | A | * | 7/1996 | Szczesuil et al. | 2/458 |
| 5,643,336 | A | * | 7/1997 | Lopez-Claros | 165/46 |
| 5,658,324 | A | * | 8/1997 | Bailey et al. | 607/104 |
| 5,755,275 | A | * | 5/1998 | Rose et al. | 165/46 |
| 5,871,526 | A | * | 2/1999 | Gibbs et al. | 607/104 |
| 5,885,912 | A | | 3/1999 | Bumbarger | |
| 5,967,225 | A | * | 10/1999 | Jenkins | 165/46 |
| 6,105,382 | A | * | 8/2000 | Reason | 165/46 |
| 6,178,562 | B1 | * | 1/2001 | Elkins | 62/259.3 |
| 6,216,771 | B1 | * | 4/2001 | Holmberg et al. | 165/46 |
| 6,230,501 | B1 | * | 5/2001 | Bailey et al. | 62/51.1 |
| 6,349,412 | B1 | * | 2/2002 | Dean | 2/102 |
| 6,565,699 | B1 | * | 5/2003 | Szczesuil et al. | 156/292 |
| 2003/0145946 | A1 | * | 8/2003 | Szczesuil et al. | 156/290 |

(Continued)

FOREIGN PATENT DOCUMENTS

| | | | | |
|---|---|---|---|---|
| GB | 1493345 | * | 11/1972 | 165/46 |
| GB | 1550351 | * | 8/1979 | 165/46 |

(Continued)

*Primary Examiner*—Ljiljana Ciric
(74) *Attorney, Agent, or Firm*—Kilpatrick Stockton LLP

(57) ABSTRACT

A body heating/cooling apparatus includes a vest having a front panel and a back panel defining a cavity therebetween. A flexible, continuous channel is disposed in serpentine fashion throughout the cavity and has adjacent portions. An inlet and an outlet are provided for infusing a fluid into the channel and for withdrawing the fluid from the channel. The adjacent portions of the channel are placed in fluid communication by passageways extending between corresponding adjacent portions at locations intermediate the ends of the adjacent portions. The passageways are configured with respect to the corresponding adjacent portions such that substantially all of a fluid flowing through the corresponding adjacent portions normally bypasses the passageways. The passageways are configured with respect to the corresponding adjacent portions such that if one of the corresponding adjacent portions suffers a constriction, fluid will enter a connected one of the passageways to flow from one corresponding adjacent portion to another so as to bypass the constriction.

12 Claims, 9 Drawing Sheets

U.S. PATENT DOCUMENTS

| | | | | |
|---|---|---|---|---|
| 2003/0150049 | A1 * | 8/2003 | Szczesuil et al. | 2/458 |
| 2003/0150545 | A1 * | 8/2003 | Szczesuil et al. | 156/292 |
| 2003/0150554 | A1 * | 8/2003 | Szczesuil et al. | 156/292 |

FOREIGN PATENT DOCUMENTS

| | | | | |
|---|---|---|---|---|
| JP | 0117035 | * | 6/1985 | 165/46 |
| JP | 0140595 | * | 5/1990 | 165/104.14 |

* cited by examiner

BODY HEATING/COOLING APPARATUS

BACKGROUND OF THE INVENTION

1. Field of the Invention

The present invention generally pertains to apparatus for external heating or cooling of the body. In particular, the present invention pertains to a body heating/cooling apparatus with a vest that covers all or most of the user's torso so as to protect the major internal organs of the body from extreme ambient temperatures. The invention also pertains to a body heating/cooling apparatus with a base unit that can service a plurality of vests to accommodate multiple users.

2. Discussion of Background

During racing competitions held in warmer climates or during the summer months the temperatures inside the racing vehicles can become very high. The heat from the engine, the other cars, and the racetrack surface has a cumulative effect on the temperature inside the vehicle and may expose the driver to extreme temperatures during the course of a race.

There are many physical problems that may result from prolonged exposure to heat including heat exhaustion, heat stroke, and dehydration. For most racing applications there are existing devices for cooling the driver's helmet during the race. There have also been attempts at providing articles of clothing for cooling the body of the driver during the race. The previous methods for cooling the body under race conditions have not been accepted for several reasons including the complexity of the systems and the discomfort associated with use of the systems particularly over an extended period of timer.

When adding a cooling system to a car designed for competition, the most important factors are weight and electrical power requirements. Both of these factors can reduce the horsepower output from the engine. Accordingly, the decision to add weight or to increase the electrical load must be considered carefully. Extra weight slows down the vehicle, and extra consumption of power requires more of the horsepower from the engine to be used for electrical power requirements.

In U.S. Pat. No. 5,967,225 entitled "Body Heating/Cooling Apparatus," I describe a battery-operated body heating/cooling apparatus comprising an enclosure for raising or lowering the temperature of a fluid prior to circulating the fluid through a vest. The enclosure has a plurality of compartments for holding ice and water, and may also be equipped with a module for also providing helmet cooling for racing car applications (or other applications where supplemental cooling of the user's head is desired). In operation, the appropriate compartments are filled with ice and water, and the apparatus is mounted inside a vehicle such as a racecar. Electrical connection to the automobile battery is made with quick-connect lugs, and the driver can turn the apparatus on and off via a manual switch. While this apparatus is lightweight, safe, requires a minimum of electrical current, and is capable of reliably and efficiently cooling a vest (and optionally a helmet), the enclosure can only service one vest at a time. Once the vest is disconnected from the enclosure, its useful operating time is limited to approximately 10–15 minutes.

There is a need for a portable, lightweight, efficient, cost-effective body heating/cooling system that can service one vest or a plurality of vests as may be needed, and that provides an extended operating time for the user.

SUMMARY OF THE INVENTION

Generally described, the present invention provides a cooling apparatus for cooling the body which operates by circulating a cooling fluid through a vest worn by the user. Alternatively, the apparatus circulates a suitable warming fluid through the vest so as to warm the user's body.

In one preferred embodiment, the present invention provides an enclosure having a first chamber disposed inside the enclosure and containing a fluid (the terms "fluid" and "liquid" are used interchangeably in this specification). The fluid is circulated through the system by a pump disposed inside the first chamber. The pump has an intake port and an outlet for convoying the fluid through tubing. A second chamber is disposed inside the enclosure and contains a cooling medium. The tubing extends from the outlet of the pump and carries the fluid from the pump through the second chamber such that the fluid loses heat while passing through the second chamber. The temperature in the second chamber is much cooler than the initial temperature of the fluid, and the result is cooling of the fluid as it passes through the tubing inside the second chamber.

After the fluid passes through the tubing in the second chamber, the fluid enters a cooling vest that is worn by the user (racecar driver, outdoor worker, etc.). The vest has an inlet and an outlet and a cavity disposed therebetween. The inlet of the vest is connected to the first tube such that fluid is capable of flowing from the inlet to the outlet through the cavity. The flow of the cool fluid through the vest worn by the driver has a cooling effect which reduces the effect of the heat encountered during the race. A return tube extends from the outlet of the cooling vest back to the first chamber in the enclosure such that the fluid returns to the first chamber after passing through the cooling vest. Once the fluid is back in the first chamber it goes into the pump and recirculates through the system.

In an alternate embodiment the apparatus described above is combined with an apparatus for providing cool air to the helmet of the driver. The additional apparatus requires four additional chambers inside the enclosure. A third chamber (the first and second chamber are part of the apparatus described above) has a cooling medium and an inlet and an outlet. A blower connects to the inlet of the third chamber and forces air through the chamber: A fourth chamber is disposed inside the enclosure adjacent to the third chamber and has a cooling medium inside. A filter is positioned between the between the third chamber and the fourth chamber to remove impurities from the incoming air. A fifth chamber is disposed adjacent to the fourth chamber and has a pressure equalization tube extending from the fourth chamber to the fifth chamber. The air from the blower passes through the third chamber into the fourth chamber. The fourth chamber is connected to a fifth chamber by an opening positioned in a divider between the chambers. The opening is equipped with a filter.

A sixth chamber is disposed adjacent to the fifth chamber and has an outlet with an opening extending to the outside of the enclosure. A dividing wall having a plurality of apertures is positioned between the fifth and sixth chamber.

In a preferred embodiment of the invention, the vest includes a multilayered composite material which has a fluid-absorbing layer, and may have additional layers including a protective layer, a retaining layer, and a conductive layer, the water-absorbing layer (also termed herein the "filler layer") being intermediate the retainer and conductive layers. The protective layer, if present, has specific characteristics for protection against extreme temperatures, physical impacts and the like, and thus provides additional protection for the user.

An important feature of the present invention is the cooling/heating unit which may be an enclosure that provides either cooling or heating capability, or both cooling and heating capability depending on the particular selection of unit (hereinafter, the enclosure is referred to as providing cooling/heating or heating/cooling). Liquid circulated through the enclosure is cooled or heated, depending on the desired effect and the ambient temperatures where the apparatus is to be used. The enclosure is preferably battery-powered, either from a self-contained battery, an AC-to-DC converter, or by connecting it to an automobile battery. Alternatively, the cooling/heating unit may take the form of a refrigerator, heater, thermoelectric or Peltier-type unit that cools (or heats) the operating fluid. Under some circumstances, the temperature of the fluid may be sufficiently cooled (or heated) simply by placing the vest inside the unit for a period of time. The unit may be configured for servicing one vest, or a plurality of vests simultaneously and/or sequentially.

Another important feature of the present invention is the vest, which allows the user to conduct his or her chosen activities in relative comfort despite uncomfortable or extreme ambient temperatures. Depending on the selected mode of operation of the enclosure (or other useful heating/cooling unit) and associated equipment, the vest can either provide cooling (for use in hot ambient temperatures) or heating (for use in cold temperatures), for as long as two (2) hours depending on the selection of materials and the ambient temperature. It can be recharged in typically less than a minute, without needing to be taken off by the user. Thus, the user can easily recharge the vest as many times as needed during the day. Alternatively, the user can simply exchange one vest for a freshly-charged vest.

Still another feature of the present invention is the composite material used in the vest. The composite material is preferably a multi-layered, liquid-retaining composite which may include, in sequence, a water-impermeable, breathable coating, a fluid-absorbing filler layer impregnated with super-absorbent polymer particles, and a retainer layer. The composite material provides added cooling or heating capabilities to the vest, extending the useful duty cycle to as long as two (2) hours.

Yet another feature of the present invention is the selection of the cooling medium and the fluid. The cooling medium may be ice, which is readily available and inexpensive. Similarly, the fluid may be water (preferably distilled water to reduce scale formation and corrosion in the apparatus). In a preferred embodiment of the invention, the fluid consists of a mixture of water and a nontoxic, nonreactive antifreeze such as propylene glycol, which does not freeze during operation of the apparatus and thereby contributes to its efficiency. When used for heating, other useful substances may be substituted.

Other features and advantages of the present invention will be apparent to those skilled in the art from a careful reading of the Detailed Description of Preferred Embodiments presented below and accompanied by the drawings.

BRIEF DESCRIPTION OF THE DRAWINGS

The invention is illustrated in the drawings in which like reference characters designate the same or similar parts throughout the Figures of which.

DETAILED DESCRIPTION OF PREFERRED EMBODIMENTS

Figure 1:
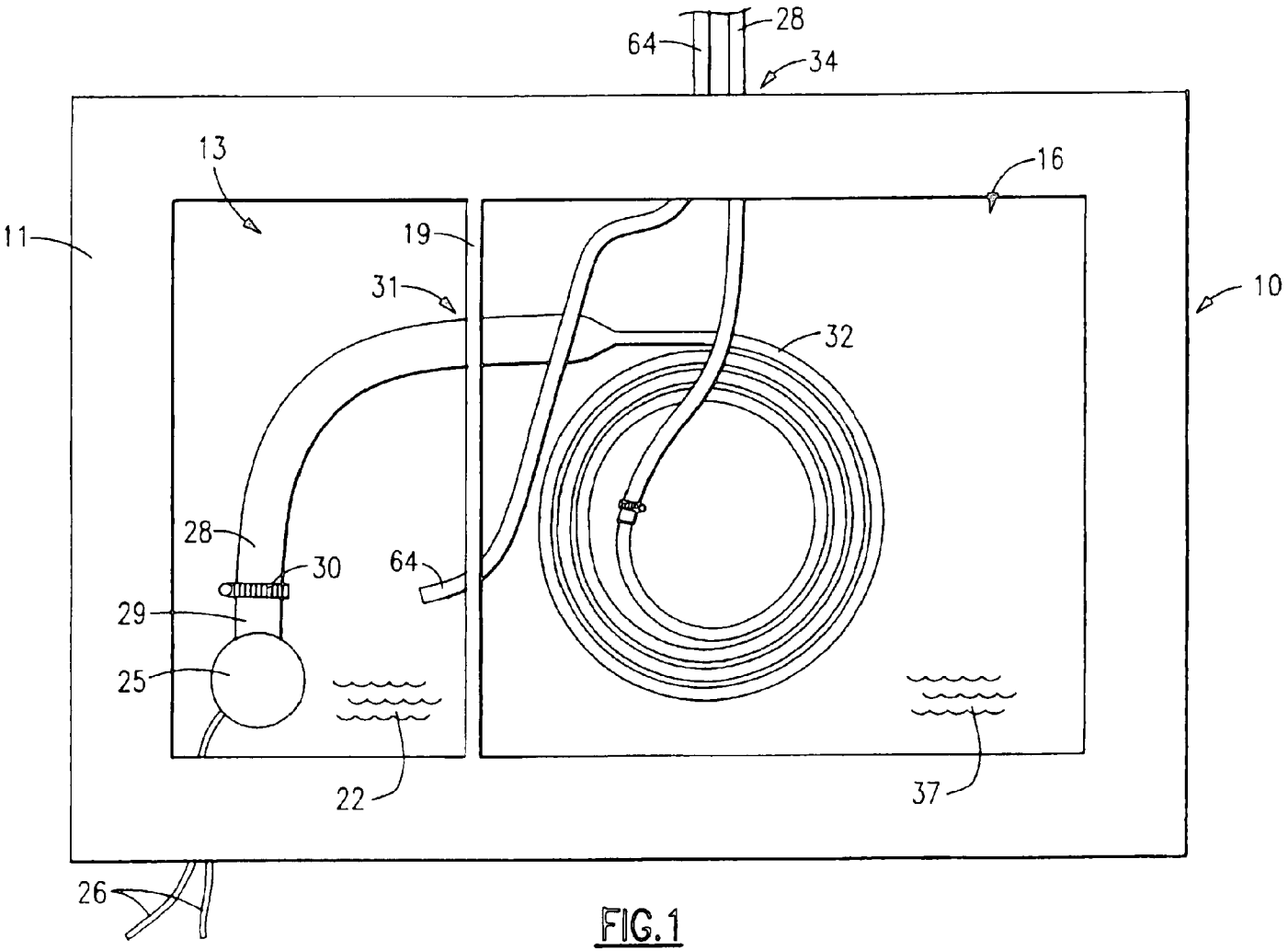
FIG. 1 is a cutaway plan view of the heating/cooling enclosure of the present invention.

In the following detailed description of the invention, reference numerals are used to identify structural elements, portions of elements, surfaces or areas in the drawings, as such elements, portions, surfaces or areas may be further described or explained by the entire written specification. For consistency, whenever the same numeral is used in different drawings, it indicates the same element, portion, surface or area as when first used. Unless otherwise indicated, the drawings are intended to be read together with the specification, and are to be considered a portion of the entire written description of this invention as required by 35 U.S.C. § 112. As used herein, the terms "horizontal," "vertical," "left," right," "up," "down," as well as adjectival and adverbial derivatives thereof, refer to the relative orientation of the illustrated structure as the particular drawing Figure faces the reader.

The preferred embodiments of the present invention are described in terms of a cooling apparatus; however, the invention is not intended to be limited in that way as the apparatus can be readily modified to provide for heating or both heating and cooling.

Referring to FIG. 1, there is shown a preferred embodiment of the apparatus of the present invention wherein a heating/cooling unit takes the form of an enclosure 10 which is preferably formed out of a material with thermal insulating properties. The specific type of material is not critical but it should have certain properties such as insulating ability, durability, and the ability to accept a plastic coating on the outside. Suitable materials include, but are not necessarily limited to, polystyrene resins such as STYRON and STYROFOAM, polyurethane, polyvinyl chloride, closed-cell polystyrene foam, and so forth. The enclosure 10 has an outer wall 11 with sufficient thickness to provide insulation. The inside of enclosure 10 is divided into a first hollow chamber 13 and a second hollow chamber 16, which are bordered by a common dividing wall 19. The dividing wall 19 is preferably made of a rigid plastic or other suitable material, but the seal between the two chambers does not have to be airtight or gas tight. However, the seal should preferably be liquid tight (i.e., substantially impermeable to fluids) at the bottoms of chambers 13, 16 in order to prevent a fluid 22 from passing from the first chamber 13 to the second chamber 16.

A pump 25 takes in the fluid 22 and pumps it into a first tube or inlet port 28. The pump 25 is preferably a submersible bilge-type pump that pumps the fluid at a pressure of approximately 10 pounds per square inch. By way of example, a suitable pump is available from ITT Jabsco in Costa Mesa, Calif. under part number 30220-1012, model number 400. The ITT pump is capable of flow rates up to 400 gallons per hour, draws only 2 amperes of current, and can be powered by 12 volts DC. A pair of motor wires 26 extend from the pump 25 and can be wired to the DC output of the automobile battery of a car or other DC power source. Other pumps are also suitable for the practice of the invention as long as they are light in weight, consume a minimum amount of electricity and are capable of generating enough pressure to keep the fluid 22 moving through the system. The tube 28 is preferably a flexible, plastic tubing suitable for plumbing applications, such as tetrafluoroethylene (TFE) or polytetrafluoroethylene (PTFE) tubing, silicon rubber, and other durable materials that are nonreactive with fluid 22.

Fluid 22 exits the pump 25 and enters the first tube 28 which is typically attached to an output port 29 by a standard band clamp 30. The fluid 22 is then carried by the first tube 28 into the second chamber 16 through an opening 31 in the dividing wall 19. Once the first tube 28 enters the second chamber 16, the tube preferably transitions from plastic to copper by means of an adapter. Copper and copper alloys are particularly useful because of their thermal conductivity and noncorrosiveness; however, other materials with these properties are also useful. The copper tubing section 32 of the first tube 28 extends in several loops around the second chamber 16. After the final loop, the first tube 28 exits the enclosure 16 through an opening, and the cooling medium 37 removes heat from the fluid 22 as it circulates through the first tube 28. The preferred cooling medium 37 is ice because it is inexpensive, non-toxic, and readily available. However, other cooling media may also be used. For example, dry ice (i.e., the solid form of carbon dioxide) and refreezable coolants such as BLUE ICE can be used with the invention. In the alternative, the second chamber 16 could be equipped with a heating element (not shown) to provide for heating a fluid to circulate through the vest and provide heating to the user.

The fluid 22 in the first chamber may be water, preferably distilled water to deter the buildup of scale and corrosion of the fluid-exposed metal parts of enclosure 10. Other fluids (or mixtures of such fluids) that are suitable for circulation through a closed loop cooling system, and also capable of absorbing and releasing heat, may be substituted. Water is useful because it is non-toxic. Mixtures of water with antifreeze are also broadly suitable for use with the invention: when the cooling medium 37 is ice, operation of pump 25 may lead to freezing of tubes 28, 32, which disables the entire system. By using a mixture of water and antifreeze as fluid 22, the fluid circulating through tubes 28, 32 (and therefore chambers 13, 16) does not freeze, eliminating any need for adding water to the ice side of the system (i.e., second chamber 16) to prevent freezing. This considerably prolongs the time the ice (or other coolant) in second chamber 16 lasts, thereby furthering the overall efficiency of the system.

The term "antifreeze" as used herein refer to any compound that, when added to water, lowers the freezing point thereof. Salts such as sodium chloride and magnesium chloride may be used; however their extreme corrosive properties are a liability when used with any exposed metal components. Ethanol and methanol are also effective antifreezes, but are flammable and tend to evaporate rapidly at the operating temperatures of enclosure 10. The preferred antifreezes for use with the present invention are nonflammable, relatively noncorrosive, have relatively low evaporation rates, and are also effective heat-exchange agents. Antifreezes which meet these requirements include glycol derivatives such as ethylene and propylene glycol. For example, a mixture of water and propylene glycol (with a concentration of 10–50 vol. % propylene glycol) can be carried in a cooling system for months (even years) without damaging the system, producing satisfactory cooling at a wide range of ambient temperatures. The most preferable antifreeze for use with the invention is propylene glycol due to its relative nontoxicity (propylene glycol is used in food products, cleansing creams, and pharmaceuticals). Additional useful compositions include polydimethylsiloxane (PDMS), an oxidation-resistant silicone polymer, antifreezes such as Dow Corning 200, and various heat transfer media such as DOWFROST and DOWTHERM.

The copper tubing section 32 is constructed of a sufficient length and number of turns to ensure that sufficient cooling occurs while the fluid 22 is circulating through the second chamber 16 in the tube 28. Thus, the optimum length and number of turns of tubing 32 depend on the dimensions of chambers 13 and 16, the inner diameter (i/d) of the tubing, the selection of fluid 22 and cooling medium 37, and the desired degree of cooling, and are best selected via a modest degree of experimentation and observation by those of ordinary skill in the art.

Figure 2:
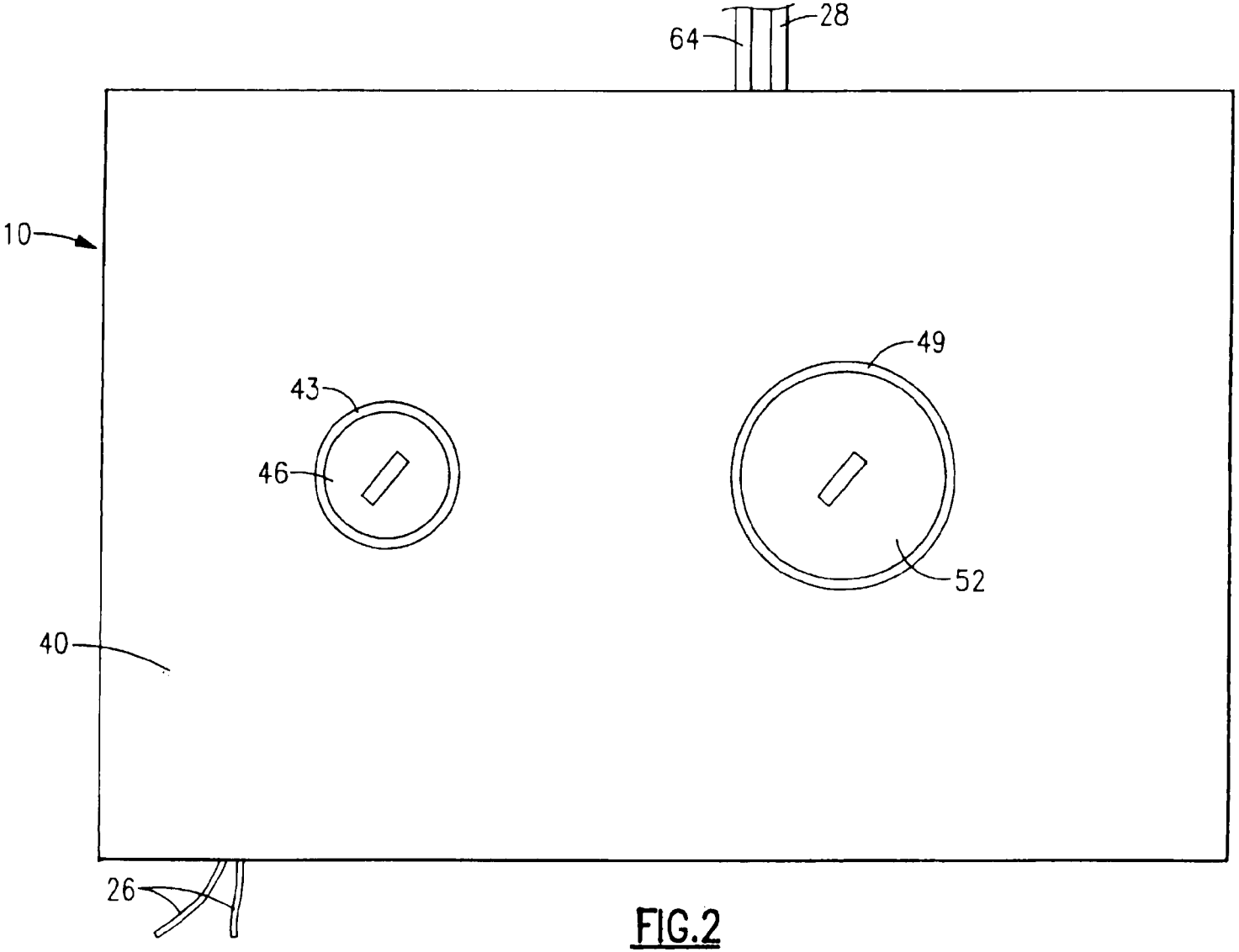
FIG. 2 is a plan view of a heating/cooling unit of the present invention in the form of an enclosure.

Turning to FIG. 2, the outside of the enclosure 10 may be coated with a hard plastic shell 40 that is preferably sprayed onto it. The plastic shell 40 may be sprayed onto the enclosure 10 by the same process and in the same manner as spray-on truck bed liners are formed. However, other materials such as polyethylene, nylon, and other polyamide polymers may also be useful, as may other processes. The hard plastic shell 40 protects the chambers 13 and 16 from dirt, debris, and damage. The enclosure 10 will normally be filled with the cooling medium 37 and the fluid 22 (for example, ice and water, respectively) prior to use and the shell 40 protects the unit during transport and storage. Also, the shell 40 functions as an additional thermal insulation barrier.

The enclosure 10 provides easy access for replacing the fluid 22 and the cooling medium 37. A first pipe stub 43 is preferably constructed of approximately 2" (about 5 cm) outside diameter (o/d) PVC pipe and has a removable cap 46 attached to it to provide access for filling the first chamber 13 with water or other suitable fluid. A second pipe stub 49 has an approximately 4" (about 10 cm) o/d and has a removable cap 52 attached to it. The second pipe stub 40 provides an opening for filling the second chamber 16 with ice or other coolant. Other pipe sizes known to those skilled in the art are contemplated as being within the scope of be present invention.

Figure 3:
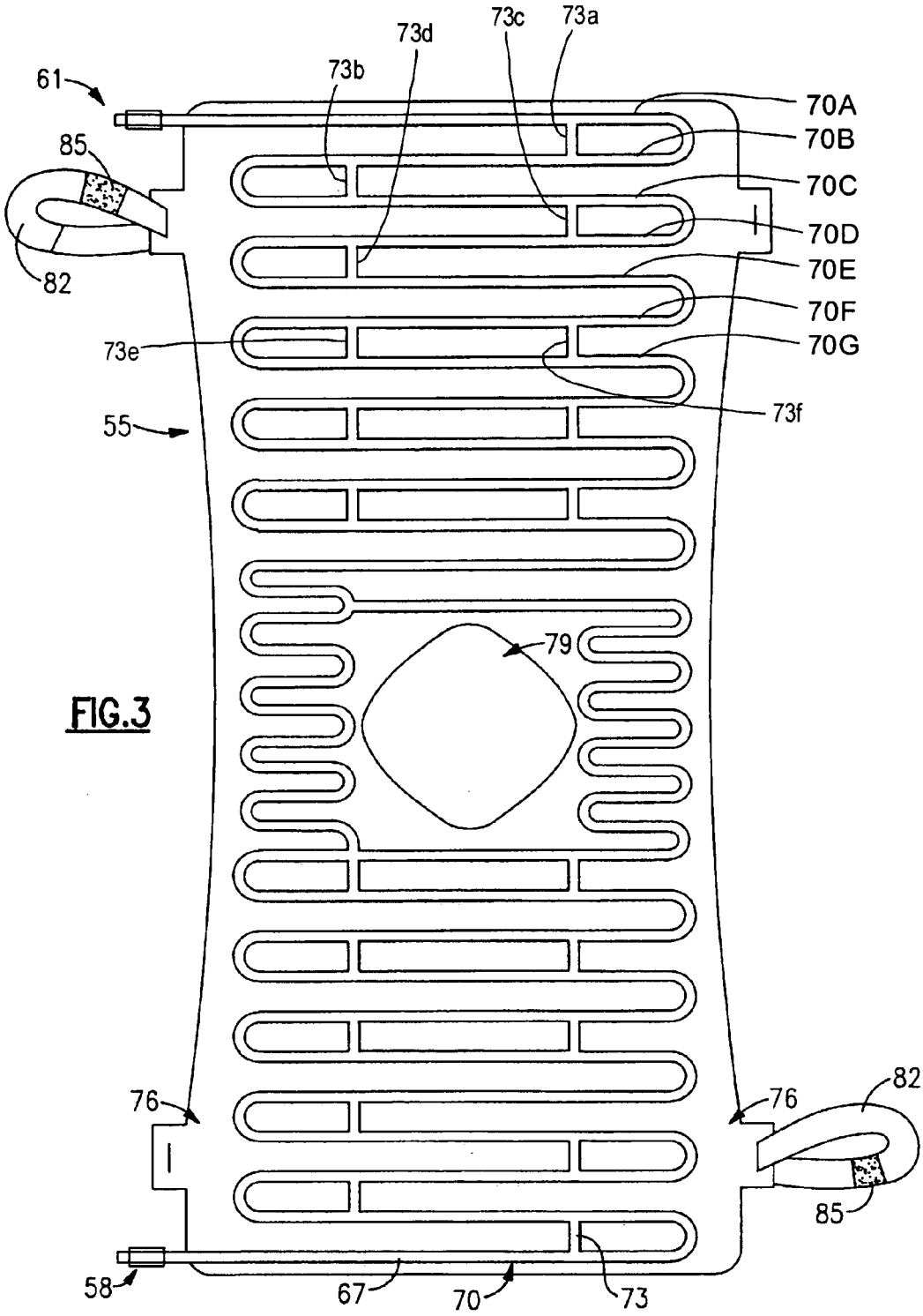
FIG. 3 is a top view of the vest of the present invention.

Turning to FIG. 3, a cooling vest 55 has a pair of quick-connect valves 58 and 61 (preferably one-way quick-connect valves such as are known in the art) attached at opposite ends which connect to the first tube 28 and the return line 64 (shown in FIGS. 1 and 2) by male-female connectors, quick-connects, or other suitable devices. The vest 55 is formed out of two layers of flexible plastic that form inner and outer panels, the layers being heat sealed with a flexible channel 67 therebetween (the channel 67 may be integrally formed with the plastic layers). While heat-sealing is preferred, other techniques, including but not limited to the use of compatible adhesives, for securely fastening the two layers together may also be useful.

The channel 67 enables fluid 22 to pass through the vest 55 and is arranged in serpentine fashion throughout the vest 55. The fluid 22 is continuously pumped through the vest 55 from the input valve 58, which serves as an inlet port for circulation of the fluid through the vest 55, to the output valve 61. The serpentine pattern of the channel 67 is formed by a plurality of lengths 70 that wind back and forth throughout the vest 55. Suitable plastics include thermoplastic polymers such as SARAN and other polyvinylidene chlorides, polyvinylidene fluoride, and other flexible, relatively nontoxic materials.

Adjacent lengths 70 of channel 67 are connected to one another by a short passageway 73 positioned between the ends 76 of the length of channel 67. For example, lengths 70A and 70B are adjacent lengths and are connected to one another by the passageway 73*a*. Lengths 70B and 70C are adjacent lengths and are connected by passageway 73*b*. Adjacent lengths 70C and 70D are connected by passageway 73*c*. Adjacent lengths 70D and 70E are connected by passageway 73*d*. Lengths 70E and 70F, while adjacent to one another, are not interconnected by a passageway. On the other hand, adjacent lengths 70F and 70G are interconnected by two passageways, 73*e* and 73*f*. It will therefore be appreciated that at least most, but not necessarily all, of the pairs of adjacent lengths are connected by a passageway 73, and that those adjacent pairs that are connected may be connected by one or more passageways 73. The short passageways 73 provide bypasses for the cooling fluid 22 when the main lengths 70 of channel 67 are blocked due to the position of the driver or the position of the vest 55 on the driver. When the channel 67 is not constricted the fluid 22 will pass through the channel 67 only and will not enter the short passageways 73.

The vest 55 has an opening 79 that fits over the head of the driver. Optionally, the vest 55 may include straps 82 with hook and loop fasteners 35 attached at the ends. When present, straps 82 are used to attach the front and back of the vest 55 together.

Referring back to FIG. 1, the return line 64 returns fluid 22 from the vest 55 to the first chamber 13. Once the fluid 22 reenters be first chamber 13 it is picked up by the intake of the pump 25 and recirculated through the system.

Figure 4:
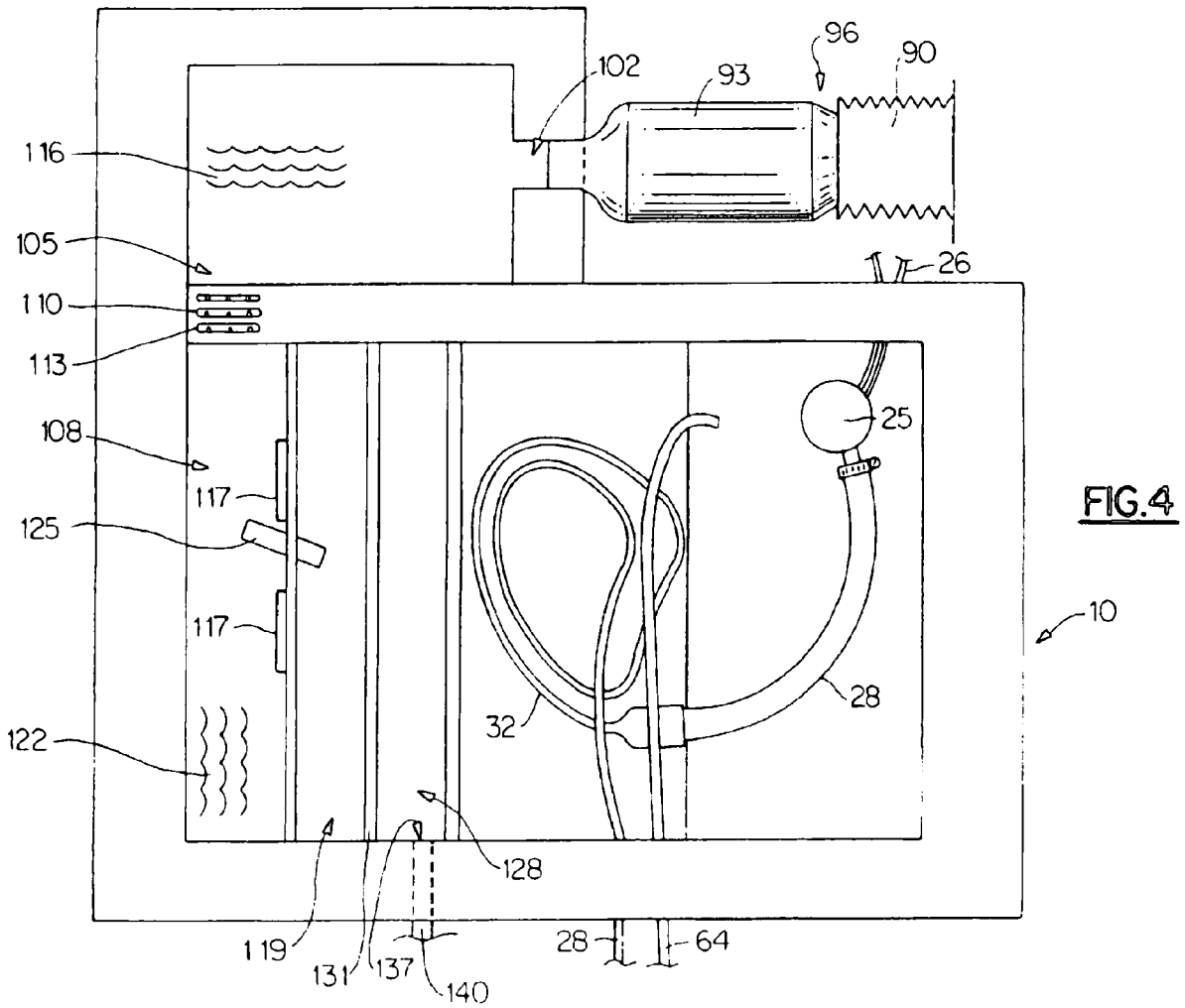
FIG. 4 is a cutaway plan view of an alternate embodiment of the enclosure of the present invention.
Figure 5:
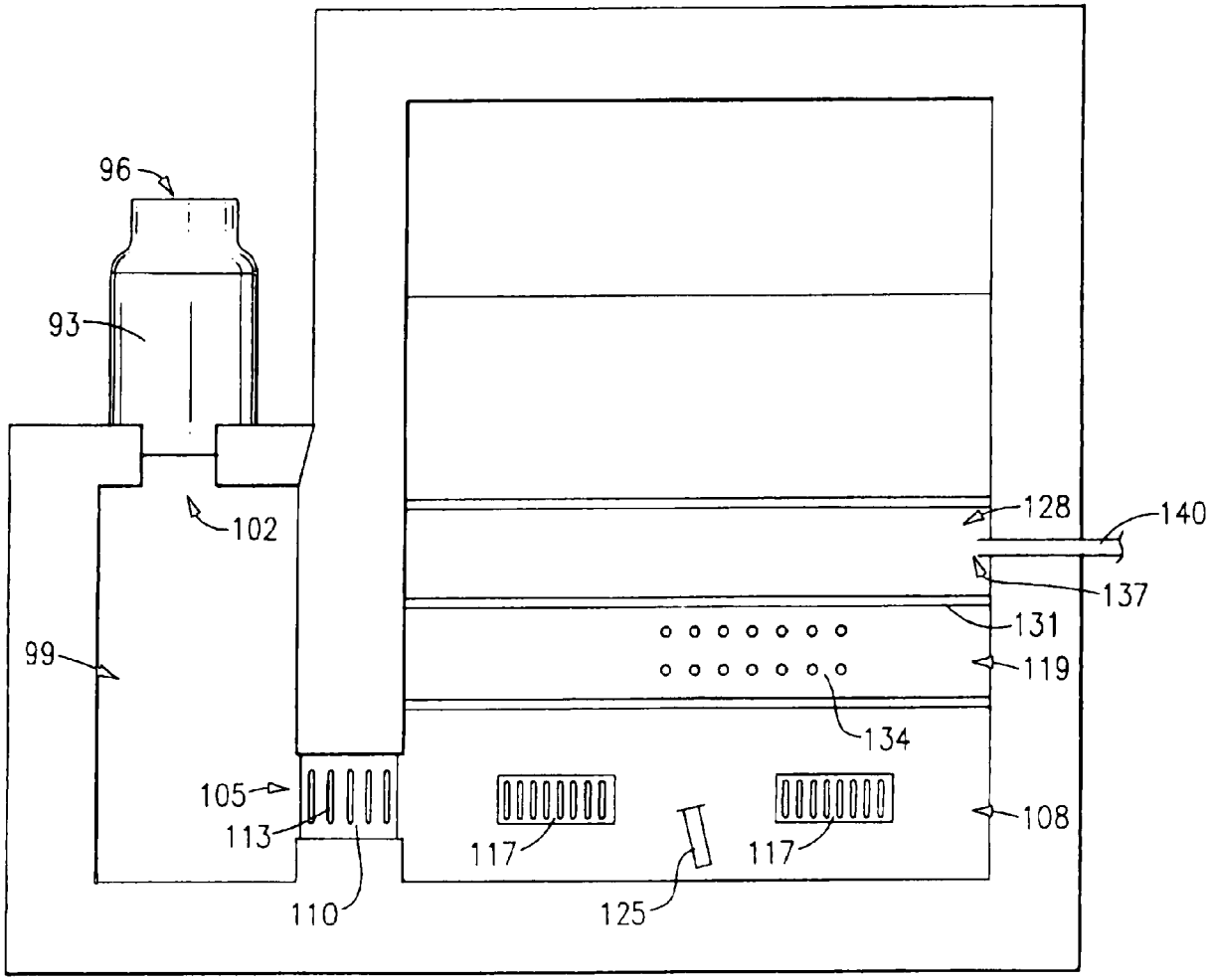
FIG. 5 is a cutaway perspective view of an alternate embodiment of the enclosure of the present invention.

FIGS. 4 and 5 show an alternate embodiment of the present invention. The alternate embodiment includes additional apparatus for cooling the driver's helmet. In order to cool the head and face of the driver, air from outside the car is gathered through a vent and conveyed through a tube 90 to a blower 93. The blower 93 produces approximately 230 cubic feet per minute (cfm) (about 109 l/sec); however, the range of cfm will vary depending on the fan or blower selected and is not critical. The intake air is taken directly from the outside of the car and may contain carbon monoxide and other gases that need to be removed prior to passing the air to the driver. Also, the air from the track is very warm and has to be cooled before it can be conveyed to the helmet.

The tube 90 conveys air from the outside of the car to the intake 96 of the blower 93. The blower 93 conveys the air into a third chamber 99. The third chamber 99 is adapted for mounting the blower 93 to an inlet 102. The third chamber 99 also has an outlet 105 that leads to a fourth chamber 105. A filter 110 is positioned inside the outlet 105 so that air passing from the third chamber 99 to the fourth chamber 105 has to pass through the filter 110. The filter 110 is preferably a cartridge type filter with activated charcoal 113 as the filter element although other filter systems known to those skilled in the art are contemplated as being within the scope of the present invention. The third chamber 99 contains a cooling medium 116 for removing heat from the air as it passes through the chamber. The cooling medium 116 is also preferably ice; however, other cooling media (including those described above) may also be suitable.

Once the air enters the fourth chamber 108 it passes through another set of filters 117, or any suitable type, to reach a fifth chamber 119. The fourth chamber 108 also has a cooling medium 122 stored in the chamber to cool the air. A pressure equalization tube 125 extends from the bottom of the fourth chamber 108 to the bottom of the fifth chamber 119. The pressure equalization tube 125 prevents the fourth chamber 108 from building up too much pressure. If the fourth chamber 108 builds up too much pressure, the water from the melting ice will be pressure conveyed into the driver's helmet. By utilizing a pressure equalizing tube 125 the pressure inside the fourth chamber 108 is controlled and air is allowed to pass through the system without picking up the water.

Air passes from the fifth chamber 119 to a sixth chamber 128 through a dividing wall 131. The dividing wall 131 has a set of apertures 134 (shown in FIG. 5) in it which allow air to pass. Air passes through the sixth chamber 128 and exits to the helmet through an outlet 137 that is connected to a tube 140. The tube 140 carries the air to the driver's helmet. The air conveyed to the helmet has been filtered to remove harmful gases and has been cooled and humidified to provide maximum comfort to the driver.

Figure 6:
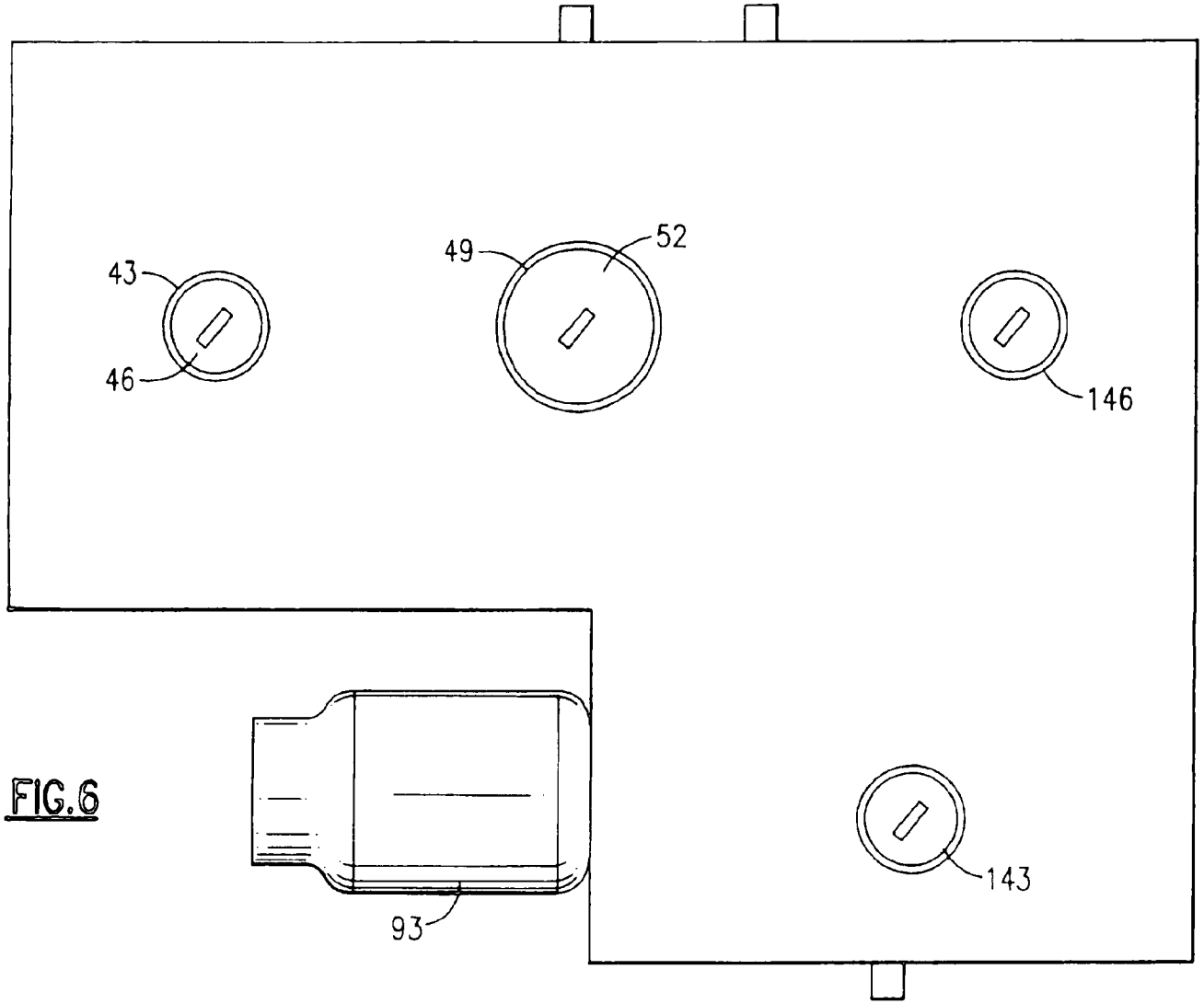
FIG. 6 is a plan view of the enclosure of an alternate embodiment of the present invention.

In FIG. 6 the enclosure 10 is shown in an alternate embodiment. In addition to the pipe stubs 43 and 49 there are pipe stubs 143 and 146 for inserting ice (or other coolant) into the third chamber 99 and the fourth chamber 108.

In operation, the apparatus is filled with ice and water (or other selected cooling medium 37 and fluid 22) in the appropriate compartments and then mounted inside a race vehicle. The electrical connection to the automobile battery is preferably made with quick connect plugs and the driver has a manual switch (not shown) to turn the system on and off. The system operates automatically such that if the battery on the vehicle is cranked and the switch for the cooling apparatus is turned on, the system will run continuously and constantly circulate the fluid 22 through the vest 55.

The cooling or heating efficacy of the above-described apparatus depends on the selection of fluid 22, cooling medium 37, and such other factors as will be evident to those of ordinary skill in the art. Once the apparatus is in operation and the vest 55 is charged (i.e., heated or cooled to within the desired starting temperature range), the user does not have to remain tethered to the pump 25: he or she may disconnect the vest 55 by disconnecting quick-connect valves 58, 61, and go about his or her business until it is necessary to recharge the vest. To recharge the vest 55, the user simply connects the valves 58, 61 to the first tube 28 and the return line 64, with or without removing the vest 55, leaves the valves connected until the desired cooling (or heating) effect is reached, and disconnects the valves. Thus, the vest 55 may be recharged as often as needed throughout a working day.

A single base unit (the enclosure 10 with pump 25 and associated components as described above) can be used with a single vest 55 in the manner described above. Depending on the environment wherein the invention is deployed, the user may prefer to disconnect valves 58, 61 from enclosure 10 once the vest 55 is charged, reconnecting the valves only when the vest 55 needs to be recharged. Alternatively, he or she may prefer to remain connected to the enclosure 10 to eliminate the need for periodic recharging of the vest 55. For applications where the user (or users) of the vest 55 do not want or need to remain connected to the enclosure 10, it will be evident that one such enclosure can service a plurality of vests 55 (or other user-wearable apparatus) in sequence.

In another embodiment of the invention, the enclosure 10 may be configured with a plurality of tubes 28 and an equal plurality of return lines 64, so that the enclosure can service a plurality of vests 55 at the same time. In this embodiment, the enclosure 10 with pump 25 and associated components as described above may be provided in a size and pumping capacity that depend on the anticipated use. For example, a single enclosure 10 could have just one pair of lines 28, 64 connectable to the valves 58, 61 of the vest 55, or a plurality of pairs of such lines (a plurality of pairs of lines 28, 64 enables the pump 25 to service an equal plurality of vests 55 at the same time).

The enclosure 10 can be a stationary (i.e., permanent or semipermanent) installation, or it can be mounted on virtually any type of vehicle, including but not limited to construction equipment, golf carts, trucks, pickup trucks, automobiles, boats, submarines, and airplanes. The enclosure 10 may be connected to the vehicle's electrical system, or it can be provided with its own self-contained power system. The pump 25 is preferably capable of pumping at least approximately one gallon per minute (about 3.8 l/min) of fluid 22; pumps with different capacities may be useful for various applications.

When the cooling medium 37 is ice and the fluid 22 is water, the above-described vest 55 will typically retain its body-cooling ability for approximately 10–15 minutes when disconnected from pump 25 (the exact time depends on the dimensions of the vest 55, the temperature to which the vest is cooled, and ambient environmental conditions). Now, surprisingly, it has been found that making the two plastic layers of above-described vest 55 of a suitable liquid-retaining composite material (or adding a layer of such material about channel 67) increases the useful duty cycle (i.e., the operating period or the time between successive recharges) of the vest by a factor of five or even more.

Figure 7:
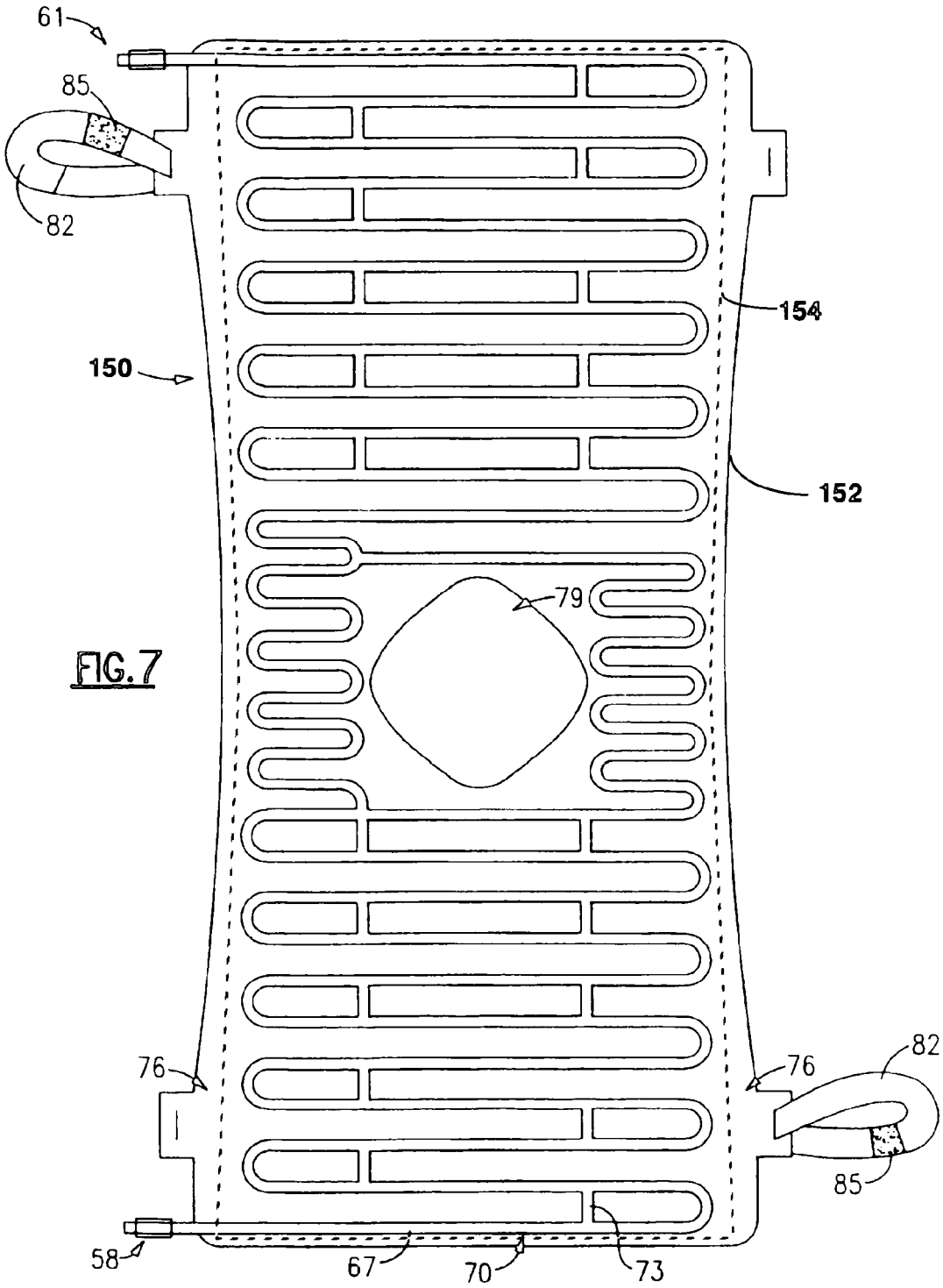
FIG. 7 is a top view of a vest of an alternate embodiment of the present invention.

Turning now to FIG. 7, there is shown a top view of a vest 150 according to the invention, wherein the vest 150 is formed of two layers of a flexible, liquid-retaining material (only a top layer 152 of the vest is shown). The vest 150, like above-described vest 55, has a flexible interior channel 67 and a pair of quick-connect valves 58 and 61 (or other suitable connectors) attached at opposite ends which connect to the first tube 28 and the return line 64 by male-female connectors, quick-connects, or other suitable devices. Alternatively, a jacket 154 surrounds the channel 67.

Figure 8:
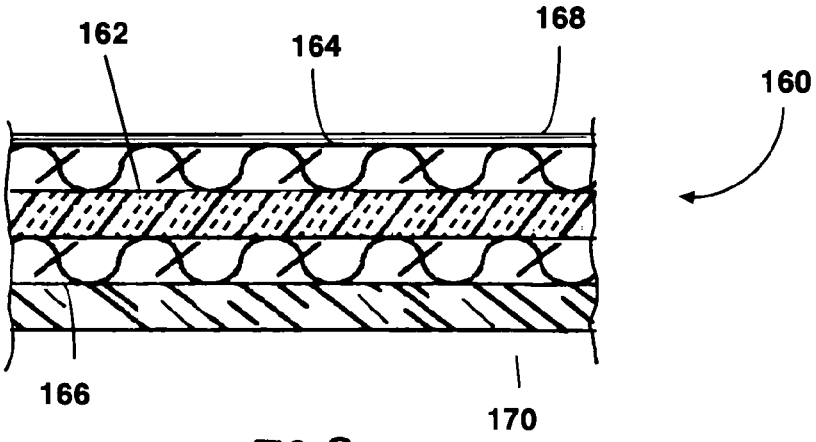
FIG. 8 is a cross-sectional view of a composite material usable with the present invention.

The layer 152 and the jacket 154 are preferably made of a multilayered composite material 160 which includes a liquid-retaining (i.e., fluid-absorbing) filler layer 162 sandwiched between two retainer layers 164, 166 (see FIG. 8). The filler layer 162 is preferably impregnated with liquid-absorbent particles; thus, the two retainer layers 164, 166 serve to keep these particles in place. At least one of the retainer layers 164, 166 may be made of a substantially water-impermeable material, preferably a water-impermeable but breathable material such as GORETEX. Alternatively, the material 160 may have a substantially waterproof coating 168. The other retainer layer is preferably a high-porosity material which permits the passage of a liquid such as water (or a water-antifreeze mixture as described above), but retains the absorbent particles of the filler layer. One or both of retainer layers 164, 166 may be made of nonbreathable materials such as NOMEX provided that provisions are made to permit the passage of liquid through the material, for example, by piercing the material with a plurality of small punctures.

The filler layer 162 may be a fiberfill batting impregnated with liquid-absorbent particles (for example, particles of super-absorbent polymer). If desired, the composite material 160 may also include one or more protective layers 170 of fire and/or impact-resistant material such as KEVLAR, NOMEX, or fire-retardant cotton or other textile. Layer 170, if present, is useful for applications wherein the user of the vest 150 may be exposed to fire or extreme heat, or require protection from gunfire or extreme impacts.

Useful composite materials for layer 152 and jacket 154 (if present) include the material marketed as HYDROWEAVE by AquaTex Industries of Huntsville, Ala. This material is described in U.S. Pat. No. 5,885,912 entitled "Protective Multi-Layered Liquid Retaining Composite," the disclosure of which is incorporated herein by reference. However, it should be understood that other materials with the desired properties are also useful for the practice of the invention.

When fully charged and disconnected from the enclosure 10, the vest 150 provides effective cooling (or heating) for up to two (2) hours or even longer, depending on the ambient temperature and the temperature of vest 150 when it is initially disconnected from the enclosure. The user can recharge (i.e., cool or heat) the vest 150 simply by reconnecting it to tubes 28, 64 and by operating pump 25. Typically, the vest 150 is cooled down and ready for use in less than a minute. Indeed, the user need not even doff the vest 150 in order to recharge it: he can simply connect valves 58, 61 to tubes 28, 64 for the required period of time. The vest 150 may, of course, be used with the helmet-cooling apparatus shown in FIGS. 4 and 5.

Above-described vests 55 and 150 preferably cover at least the upper portion of the user's body, i.e., the vests extend from the shoulders to at least just below the waist. The vests 55 and 150 may be made in any useful sizes. However, it is believed that just a few sizes (such as "small," "medium," and "large") are sufficient to accommodate most potential users.

Figure 9:
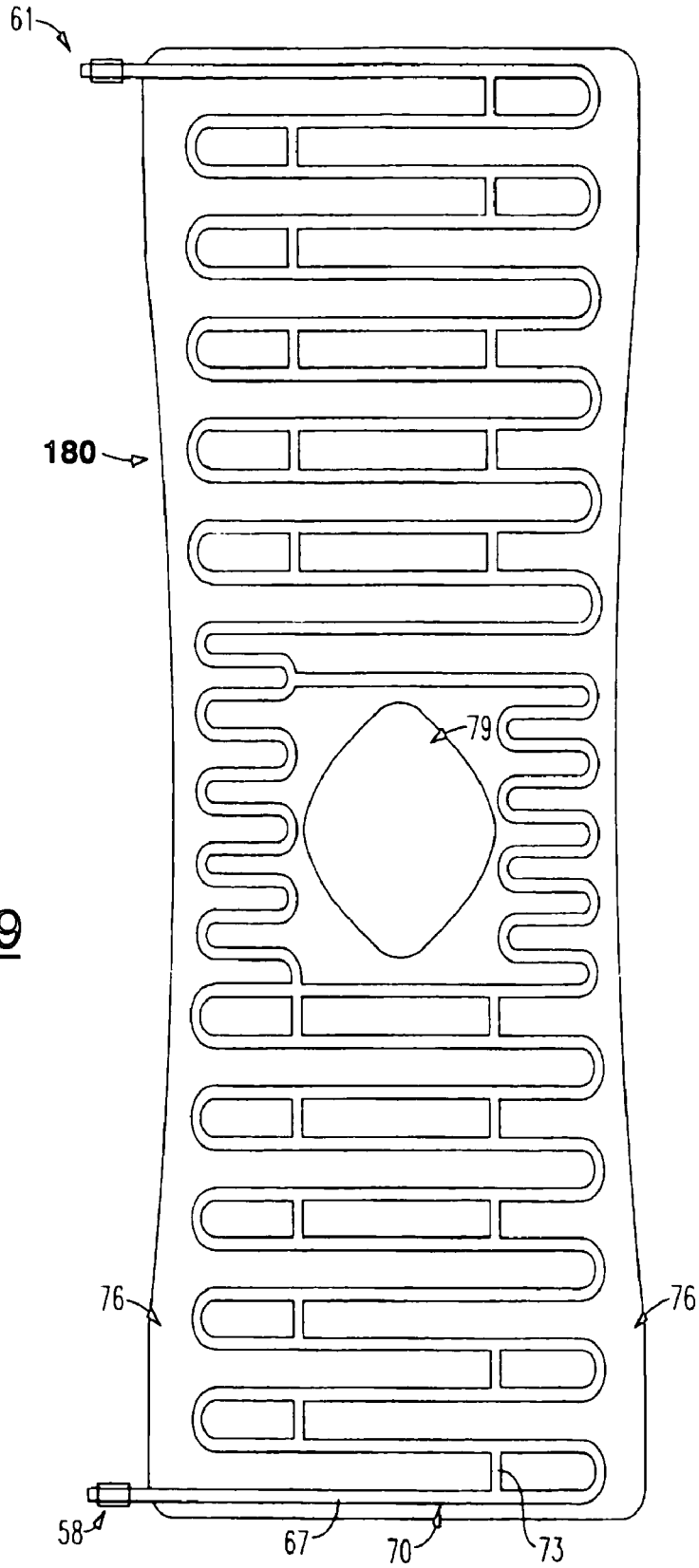
FIG. 9 is a top view of another vest according to the invention.

It is preferable to have a vest that extends at least approximately 4" (about 10 cm) below the waist so as to cover all or most of the user's torso. A vest with these dimensions protects the major internal organs of the human body (i.e., the heart, lungs, liver, stomach, spleen, pancreas, and kidneys), thereby permitting the hot blood entering the core region of the body to be cooled before going back out to the extremities. This configuration, shown in FIG. 9 as a vest 180, results in effective lowering of the body core temperature, thereby helping prevent heat-related injuries. It also enables the vest 180 (or indeed vests 55, 150) to be used as a first-line medical treatment for heat-related injuries. If desired, the vest 180 may include straps 82 with hook and loop fasteners 35 attached at the ends, used to attach the front and back of the vest 55 together.

The vests 55, 150, 180 may also be used to warm the blood when used in cold environments. (When the invention is used for heating, cold blood is warmed while in the core region of the body.)

As noted above, a single base unit such as enclosure 10 (with the pump 25 and associated components) may be fitted with a plurality of lines 28, 64 connectable to valves 58, 61 in order to have the capability of servicing a plurality of vests 55, 150, 180 at the same time. For example, enclosure 10 could be fitted with five or ten pairs of lines 28, 64, or indeed any convenient number of such lines. This feature allows a single base unit to be used for servicing a number of vests, both simultaneously and sequentially. Since the vests 55, 150, 180 have extended operating periods and can be quickly charged (i.e., cooled or heated) when used with the appropriate fluids, a number of users can access the enclosure 10 sequentially. The total number of users is limited by the number of lines 28, 64, the starting temperature of the fully-charged vest 55, 150, or 180, the useful operating time or duty cycle of the vest, the ambient temperature, and the time needed to recharge the vest.

Figure 10:
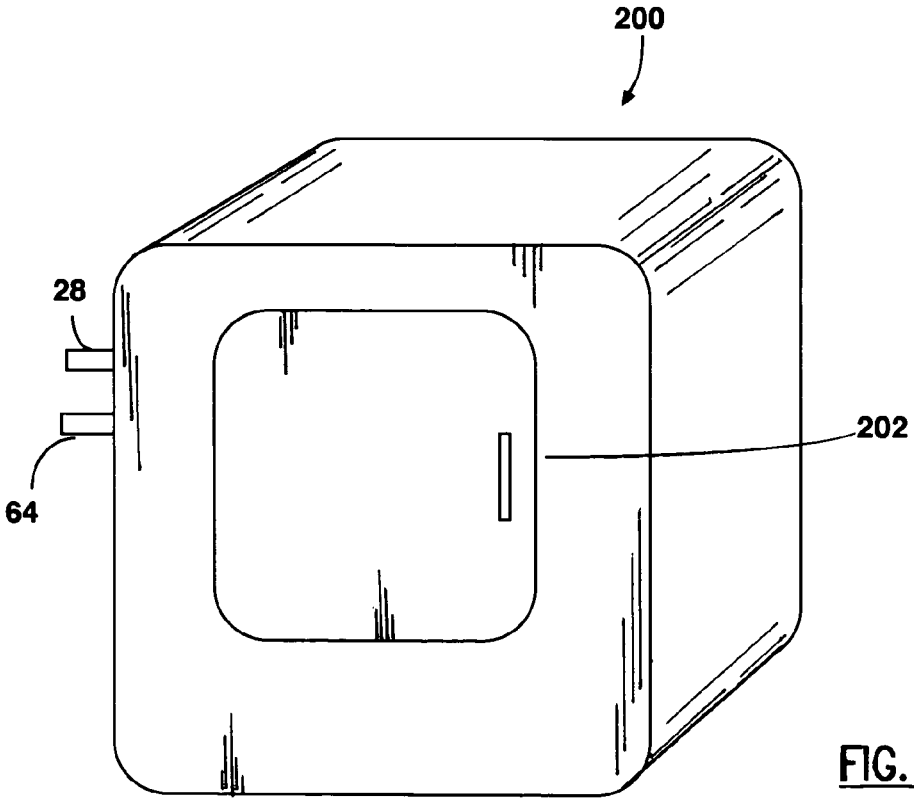
FIG. 10 is a plan view of another heating/cooling unit usable with the invention.

In still another embodiment of the present invention, the base unit may be any convenient device that can be used for changing the temperature of a vest 55, 150, 180, such as a refrigerator, heater, or Peltier unit. A temperature-changing device 200 is shown schematically in FIG. 10. The device 200 may include a pair of lines 28, 64 (and associated components) as described above for circulating fluid from the vest 55, 150, or 180 therethrough, or a plurality of such pairs of lines 28, 64. The device 200 may also include an access door or port 202 that permits access to the interior of the device, such as for maintenance purposes. Alternatively, when the vest 55, 150, or 180 is used with a suitable cooling (or heating) fluid, the vest may be cooled (or heated) simply by placing it inside the device 200 for a sufficient period of time.

While conventional refrigerators and heaters (including microwave heaters) may be useful, heating/cooling devices based on the Peltier effect (also referred to in the art as thermoelectric heating/cooling devices or "electronic heat pumps") are especially useful for the practice of the invention since they can be used for both heating and cooling applications. These devices operate via the Peltier effect, wherein heat is evolved or absorbed at the junction of two dissimilar metals carrying an electrical current, depending on the direction of the current. Thus, a Peltier device 200 can be switched from cooling items placed in its interior to heating the items simply by changing the direction of current flow. As for above-described enclosure 10, device 200 may be a stationary unit, a portable unit, or may be mounted to any suitable vehicle.

Accordingly, the present invention offers many advantages, including the ability to provide efficient cooling or heating, as may be needed, for users who are working in severe environments.

Another advantage of the present invention is that it provides a relatively lightweight system that requires very little electrical power from the vehicle battery or other power source.

Yet another advantage is that the system could easily be modified to adapt to an AC power source and be used by a pit crew during a race. The pit crews are also exposed to severe temperatures at a track. Also, the system may be adapted to many other applications where cooling or heating from a vest is desirable.

Still another advantage of the present invention is that it provides an extended use time (as long as two hours or even longer, depending on the ambient temperature and the selection of heating or cooling fluid), and can be cooled down in less than a minute while being worn. The user may, therefore, quickly and easily recharge the vest as many times as needed during a working day.

Another advantage of the present invention is that it can be used with a wide range of heating/cooling devices (the above-described enclosure 10 and device 200).

Yet another advantage of the present invention is that it allows one base unit (i.e., the enclosure 10, the device 200) to service a number of users of the vest, either sequentially (where each user connects his or her vest to the base unit in turn), simultaneously (where a plurality of users connect their vests to an equal plurality of inlet and outlet ports on the base unit), or a combination of sequential and simultaneous operation.

With respect to the above description of the invention, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing description is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. Thus, it will be apparent to those skilled in the art that many alternatives, substitutions, equivalents, and modifications can be made to the preferred embodiments herein described without departing from the spirit and scope of the present invention as defined by the appended claims.

What is claimed is:

1. A body heating/cooling apparatus, comprising:

a vest comprising a front panel and a back panel, said front panel and said back panel defining a cavity;

a flexible, continuous channel disposed in serpentine fashion throughout said cavity, said flexible, continuous channel having adjacent portions;

inlet means for infusing a fluid into said flexible, continuous channel;

outlet means for withdrawing a fluid from said flexible, continuous channel;

wherein said adjacent portions of said flexible, continuous channel are placed in fluid communication by passageways extending between corresponding adjacent portions at locations intermediate the ends of said adjacent portions;

wherein said passageways are configured with respect to said corresponding adjacent portions such that substantially all of a fluid flowing through said corresponding adjacent portions normally bypasses said passageways; and wherein said passageways are configured with respect to said corresponding adjacent portions such that if one of said corresponding adjacent portions suffers a constriction, fluid will enter a connected one of said passageways to flow from one corresponding adjacent portion to another so as to bypass said constriction.

2. The body heating/cooling apparatus of claim 1, wherein said passageways which are configured with respect to said adjacent portions such that substantially all of the fluid flowing through said corresponding adjacent portions normally bypasses said passageways comprises:

said passageways intersecting said corresponding adjacent portions at substantially a right angle.

3. The body heating/cooling apparatus of claim 1, wherein said vest further comprises a fluid-absorbing material in thermal communication with said flexible, continuous channel.

4. The body heating/cooling apparatus of claim 3, wherein said front and back panels comprise first and second retainer layers; and wherein said fluid-absorbing material is disposed between said first and second retainer layers of said front and back panels.

5. The body heating/cooling apparatus of claim 4, wherein said fluid absorbing material comprises fluid absorbing particles.

6. The body heating/cooling apparatus of claim 4, wherein at least one of said first and second retainer layers has a substantially waterproof coating.

7. The body heating/cooling apparatus of claim 4, wherein at least one of said first and second retainer layers is a high-porosity material which permits the passage of liquids.

8. The body heating/cooling apparatus of claim 4, wherein at least one of said first and second retainer layers is a fluid-impervious material having a plurality of small punctures formed therein.

9. The body heating/cooling apparatus of claim 4, wherein at least one of said first and second retainer layers comprises a substantially water-impermeable material.

10. The body heating/cooling apparatus of claim 9, wherein said substantially water-impermeable material is breathable.

11. The body heating/cooling apparatus of claim 1, further comprising:

a pump; and fluid conduits for connecting said pump to said inlet means and said outlet means for placing said pump in fluid communication with said flexible, continuous channel.

12. The body heating/cooling apparatus of claim 11, further comprising means in fluid communication with said pump for controlling the temperature of said fluid being pumped through said flexible, continuous channel.

* * * * *